US011571353B2

(12) United States Patent
Lee et al.

(10) Patent No.: US 11,571,353 B2
(45) Date of Patent: Feb. 7, 2023

(54) MOTION ASSISTANT APPARATUS

(71) Applicant: Samsung Electronics Co., Ltd., Suwon-si (KR)

(72) Inventors: Minhyung Lee, Seoul (KR); Jongwon Lee, Suwon-si (KR); Youn Baek Lee, Yongin-si (KR); Youngbo Shim, Suwon-si (KR); Byungjune Choi, Gunpo-si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 450 days.

(21) Appl. No.: 16/880,234

(22) Filed: May 21, 2020

(65) Prior Publication Data

US 2021/0128392 A1 May 6, 2021

(30) Foreign Application Priority Data

Nov. 1, 2019 (KR) ..... 10-2019-0138711

(51) Int. Cl.
*A61H 3/00* (2006.01)

(52) U.S. Cl.
CPC ..... *A61H 3/008* (2013.01); *A61H 2003/007* (2013.01); *A61H 2201/14* (2013.01);
(Continued)

(58) Field of Classification Search
CPC .... A61H 3/008; A61H 3/00; A61H 2003/007; A61H 2201/14; A61H 2201/1642; A61H 2201/165; A61H 2201/1657; A61H 2201/0192; A61H 2201/1215; A61H 2201/163; A61H 2201/1671; A61H 2201/5007; A61H 2205/083; A61H 2205/088; A61H 2205/102; A61H 1/024; A61H 1/00; A61H 1/0244; A41D 13/065; A41D 13/055; A41D 13/0556;
(Continued)

(56) References Cited

U.S. PATENT DOCUMENTS 7,201,728 B2 4/2007 Sterling
9,216,130 B2 * 12/2015 Killian ..... A61H 1/0292
(Continued)

FOREIGN PATENT DOCUMENTS

CN 109498374 A 3/2019
JP 2006-340852 A 12/2006
KR 10-2017-0019175 A 2/2017

*Primary Examiner* — Rachel T Sippel
*Assistant Examiner* — Kelsey E Baller
(74) *Attorney, Agent, or Firm* — Harness, Dickey & Pierce, P.L.C.

(57) ABSTRACT

A motion assistance apparatus includes a proximal support configured to support a proximal part of a user, a power transmitting frame configured to rotate relative to the proximal support, a driving frame connected to the power transmitting frame and configured to enclose at least a portion of a distal part of the user, a reinforcement belt attached to a front surface of the driving frame, a rear belt connected to the driving frame or the reinforcement belt and configured to support a rear surface of the distal part of the user, and a front belt with a central portion spaced apart from the driving frame, the front belt provided between the driving frame and the rear belt and configured to support a front surface of the distal part of the user.

19 Claims, 7 Drawing Sheets

(52) U.S. Cl.
CPC ..... *A61H 2201/165* (2013.01); *A61H 2201/1642* (2013.01); *A61H 2201/1657* (2013.01); *A61H 2205/083* (2013.01); *A61H 2205/088* (2013.01)

(58) Field of Classification Search
CPC ..... A41D 13/0562; A41D 13/0568; A41D 13/0575; A41D 13/0581; A41D 13/0587; A41D 13/0593; A63B 2071/125; A61F 5/01–0195
See application file for complete search history.

(56) References Cited

U.S. PATENT DOCUMENTS

| | | | | |
|---|---|---|---|---|
| 2005/0148918 | A1* | 7/2005 | Nathanson | A61F 5/0123 602/27 |
| 2005/0240135 | A1* | 10/2005 | Hoffmeier | A61F 5/0123 602/26 |
| 2011/0160626 | A1 | 6/2011 | Takahashi et al. | |
| 2011/0218466 | A1* | 9/2011 | Takahashi | A61H 1/0244 601/35 |
| 2015/0366740 | A1* | 12/2015 | Endo | A61H 1/0244 623/24 |
| 2017/0086990 | A1* | 3/2017 | Choi | A61F 5/0193 |
| 2017/0143574 | A1* | 5/2017 | Choi | F16M 13/04 |
| 2020/0206062 | A1* | 7/2020 | Kim | B25J 9/0006 |
| 2022/0249268 | A1* | 8/2022 | Kroll-Orywahl | A61F 5/0123 |

* cited by examiner

MOTION ASSISTANT APPARATUS

CROSS-REFERENCE TO RELATED APPLICATION

This application claims priority under 35 U.S.C. § 119 to Korean Patent Application No. 10-2019-0138711, filed on Nov. 1, 2019, in the Korean Intellectual Property Office, the entire contents of which are incorporated herein by reference in their entirety.

BACKGROUND

1. Field

At least one example embodiment relates to a motion assistance apparatus.

2. Description of the Related Art

Motion assistance apparatuses for assisting walking of users having joint problems are being developed. A motion assistance apparatus may include a power transmitting frame and a wearable part. However, the wearable part may not closely fit a body of a user and stably transmit power through the power transmitting frame.

SUMMARY

Some example embodiments relate to a motion assistance apparatus.

In some example embodiments, the motion assistance apparatus may include a proximal support configured to support a proximal part of a user; a power transmitting frame configured to rotate relative to the proximal support; a driving frame connected to the power transmitting frame, the driving frame configured to enclose at least a portion of a distal part of the user; a reinforcement belt connected to a front surface of the driving frame; a rear belt connected to one of the driving frame or the reinforcement belt, the rear belt configured to support a rear surface of the distal part of the user; and a front belt between the driving frame and the rear belt such that a central portion of the front belt is spaced apart from the driving frame, the front belt configured to support a front surface of the distal part of the user.

In some example embodiments, a shape of the driving frame is convex.

In some example embodiments, the rear belt, the front belt, and the reinforcement belt are non-stretchable.

In some example embodiments, the motion assistance apparatus further includes a rear pad on an inner side surface of the rear belt; and a front pad on an inner side surface of the front belt.

In some example embodiments, the reinforcement belt is configured to inhibit a left end portion of the driving frame from approaching a right end portion of the driving frame.

In some example embodiments, a left end portion of the reinforcement belt is fixed to the left end portion of the driving frame, and a right end portion of the reinforcement belt is fixed to the right end portion of the driving frame.

In some example embodiments, while the power transmitting frame is transmitting power to the driving frame in a forward direction relative to the user, the rear belt is configured to transmit an action force that pulls the left end portion of the driving frame and the right end portion of the driving frame in a rear direction relative to the user, and the reinforcement belt is configured to apply a tensile force to offset at least a portion of the action force to inhibit the left end portion of the driving frame from approaching the right end portion of the driving frame.

In some example embodiments, while the power transmitting frame is transmitting power to the driving frame in a rear direction relative to the user, the front belt is configured to transmit an action force that pulls the left end portion of the driving frame and the right end portion of the driving frame in an inward direction, and the reinforcement belt is configured to apply a tensile force to offsets at least a portion of the action force to inhibit the left end portion of the driving frame from approaching the right end portion of the driving frame.

In some example embodiments, a curvature of the front surface of the driving frame is equal to a curvature of the reinforcement belt.

In some example embodiments, a curvature of a rear surface of the driving frame is greater than a curvature of the front belt.

In some example embodiments, a length of the rear belt is greater than a length of the front belt.

In some example embodiments, a length of one of the rear belt or the front belt from a first end portion of the driving frame to a second end portion of the driving frame is adjustable.

In some example embodiments, a first end of the front belt is fixed to a first end portion of the driving frame, at least a portion of the front belt encloses a fixing member at a second end portion of the driving frame, and a second end of the front belt is between the central portion of the front belt and the driving frame.

In some example embodiments, the proximal support is configured to support a waist of the user, and the rear belt and the front belt are configured to support a thigh of the user.

In some example embodiments, the proximal support is configured to support a thigh of the user, and the rear belt and the front belt are configured to support a calf and a shin of the user, respectively.

In some example embodiments, the reinforcement belt and the front belt are provided as an integral body, and the motion assistance apparatus further includes a front length adjusting member configured to fix the reinforcement belt with the front belt.

In some example embodiments, the motion assistance apparatus further includes a belt support connected to the driving frame, the belt support configured to support the rear belt; and a rear length adjuster configured to fix a portion of the rear belt not passing through the belt support with a portion of the rear belt passing through the belt supporting part.

In some example embodiments, a first end of the rear belt is fixed to the reinforcement belt, and a second end of the rear belt passes through the belt support and is fixed by the rear length adjuster.

Other example embodiments relate to a motion assistance apparatus.

In some example embodiments, the motion assistance apparatus may include a driving frame configured to enclose at least a portion of a distal part of a user; a rear belt connected to both end portions of the driving frame, the rear belt configured to support a rear surface of the distal part of the user; a front belt connected to the end portions of the driving frame such that a central portion of the front belt is spaced apart from the driving frame, the front belt configured to support a front surface of the distal part of the user;

and a reinforcement belt extending along a front surface of the driving frame with end portions thereof fixed to the driving frame.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects will become apparent and more readily appreciated from the following description of example embodiments, taken in conjunction with the accompanying drawings of which.

DETAILED DESCRIPTION

Figure 1:
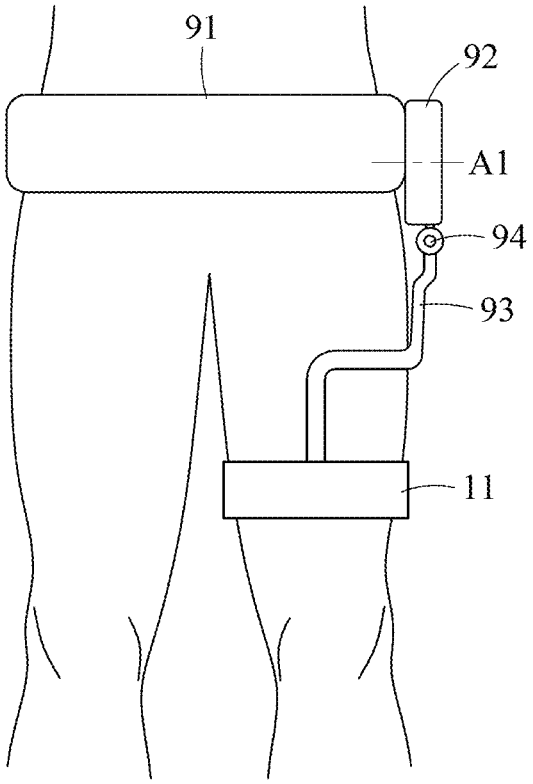
FIG. 1 is a front view illustrating a user wearing a motion assistance apparatus according to at least one example embodiment.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings. Also, in the description of example embodiments, detailed description of well-known related structures or functions will be omitted when it is deemed that such description will cause ambiguous interpretation of the present disclosure.

In addition, terms such as first, second, A, B, (a), (b), and the like may be used herein to describe components. Each of these terminologies is not used to define an essence, order or sequence of a corresponding component but used merely to distinguish the corresponding component from other component(s). It should be noted that if it is described in the specification that one component is "connected", "coupled", or "joined" to another component, a third component may be "connected", "coupled", and "joined" between the first and second components, although the first component may be directly connected, coupled or joined to the second component.

The same name may be used to describe an element included in the example embodiments described above and an element having a common function. Unless otherwise mentioned, the descriptions on the example embodiments may be applicable to the following example embodiments and thus, duplicated descriptions will be omitted for conciseness.

Figure 2:
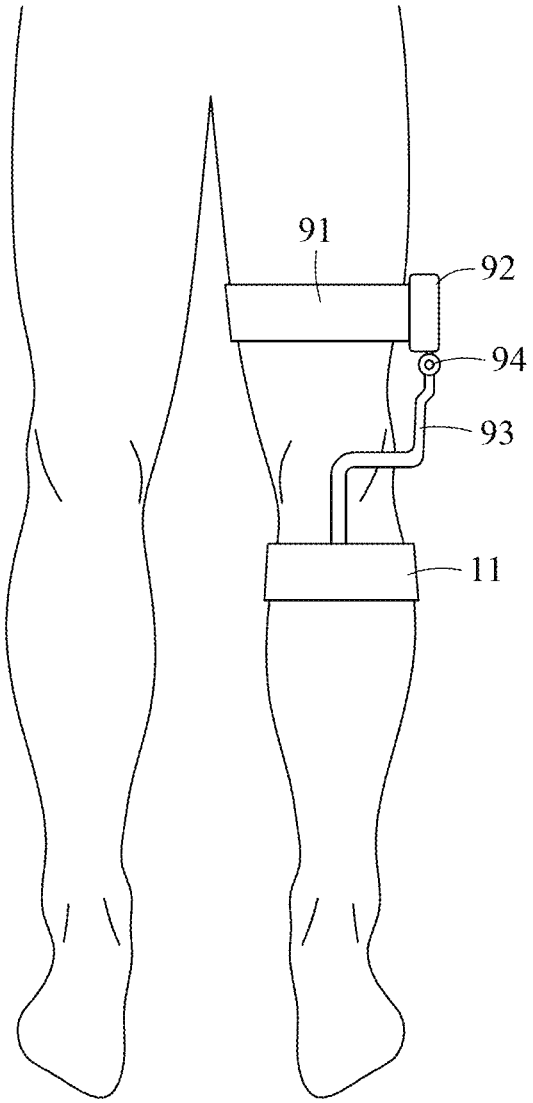
FIG. 2 is a front view illustrating a user wearing a motion assistance apparatus according to at least one example embodiment.

FIG. 1 is a front view illustrating a user wearing a motion assistance apparatus according to at least one example embodiment, and FIG. 2 is a front view illustrating a user wearing a motion assistance apparatus according to at least one example embodiment.

Referring to FIGS. 1 and 2, a motion assistance apparatus may assist an extension and/or a flexion of a hip joint and/or a knee joint of a user. The motion assistance apparatus may include a proximal support 91, a driving source 92, a power transmitting frame 93, a driving frame 11, and a wearable part (not shown).

The proximal support 91 may support a proximal part of a user. For example, the proximal part may be a waist (See FIG. 1) or a thigh (See FIG. 2) of the user. In the example of FIG. 1, when the proximal support 91 is mounted on the waist of the user, and the wearable part (not shown), which will be described later, is mounted on a thigh of the user, the motion assistance apparatus may assist an extension and/or a flexion of a hip joint of the user. In the example of FIG. 2, when the proximal support 91 is mounted on the thigh of the user, and the wearable part, which will be described later, is mounted on a shin and a calf of the user, the motion assistance apparatus may assist an extension and/or a flexion of a knee joint of the user. The proximal support 91 may be attached to and detached from the proximal part of the user, and have an adjustable length.

The driving source 92 may be connected to the proximal support 91, and generate power. The driving source 92 may include, for example, a motor.

The power transmitting frame 93 may receive the power from the driving source 92 and rotate relative to the proximal support 91 about a rotation axis A1. One end of the power transmitting frame 93 may include a rotation axis 94 connected to the driving source 92, where the rotation axis 94 may intersect the rotation axis A1, and the other end thereof may be connected to the driving frame 11. At least a portion of the power transmitting frame 93 may enclose a distal part of the user in a circumferential direction. For example, when the proximal support 91 is mounted on the waist of the user and the wearable part is mounted on the thigh of the user (See FIG. 1), the power transmitting frame 93 may be provided in the shape extending from a side surface of the thigh toward a front surface of the thigh and enclosing at least a portion of the thigh in a circumferential direction. For example, when the proximal support 91 is mounted on the thigh of the user and the wearable part is mounted on the shin and the calf of the user (See FIG. 2), the power transmitting frame 93 may be provided in the shape extending from a side surface of a shank toward a front surface of the shank and enclosing at least a portion of the shank in a circumferential direction.

The driving frame 11 may be connected to the power transmitting frame 93 and enclose at least a portion of the distal part of the user. The driving frame 11 may be spaced apart from the distal part of the user and may not directly contact the distal part of the user. The driving frame 11 may transmit the power received from the driving source 92 to the wearable part.

The motion assistance apparatus may further include a controller and a battery (not shown). The controller may include processing circuitry including, but is not limited to, a central processing unit (CPU), an arithmetic logic unit (ALU), a digital signal processor, a microcomputer, a field programmable gate array (FPGA), a programmable logic unit, a microprocessor, application-specific integrated circuit (ASIC), etc. The processing circuitry may be special purpose processing circuitry that control the driving source 92 to provide an assistance torque to the user using power provided by the battery.

The wearable part (not shown) may directly support the distal part of the user. The wearable part may be mounted on the driving frame 11. The wearable part may include, for example, a rear belt configured to support a rear surface of the distal part of the user, and a front belt configured to support a front surface of the distal part of the user. For example, the wearable part may have a closed-loop shape enclosing the distal part. The wearable part will be described further below with reference to FIGS. 3A through 5.

Figure 3A:
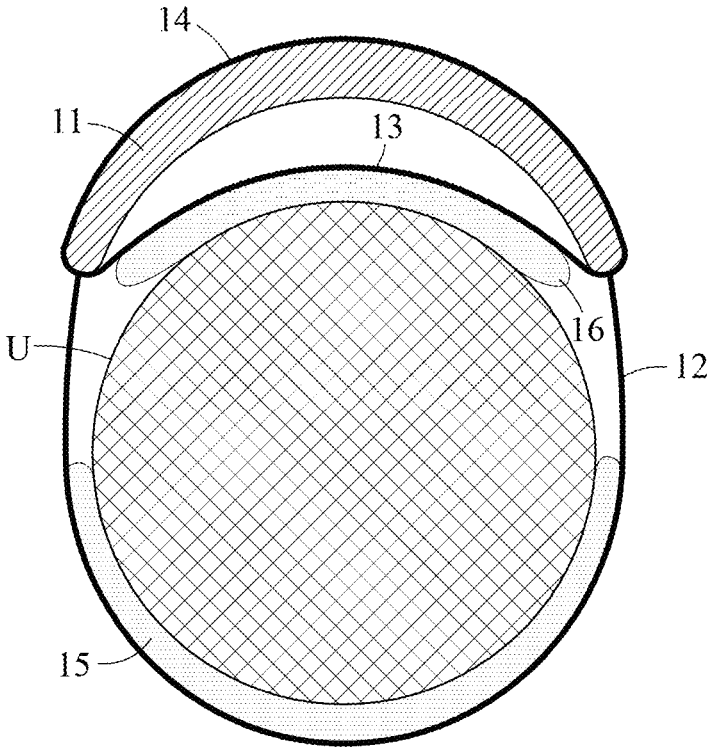
FIG. 3A is a cross-sectional view illustrating a motion assistance apparatus according to at least one example embodiment.
Figure 3B:
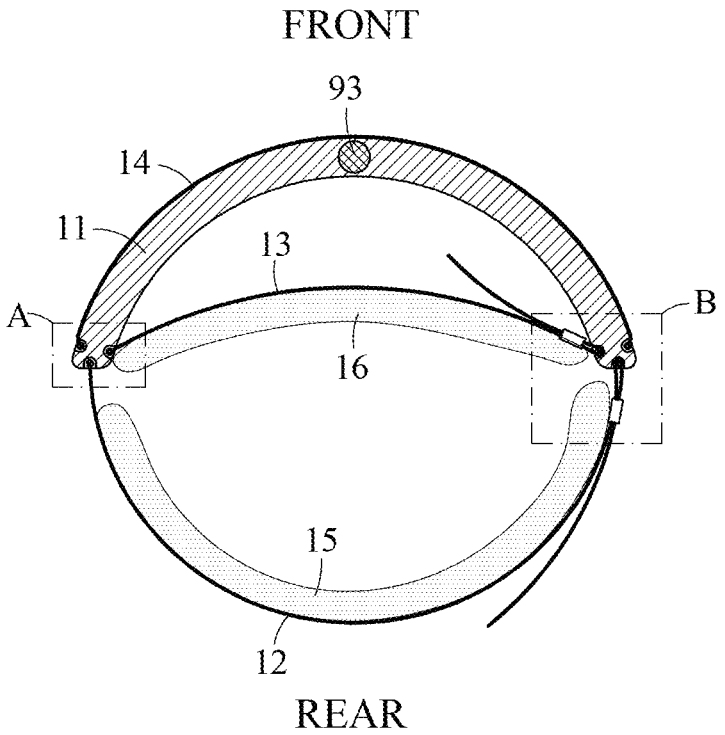
FIG. 3B is a cross-sectional view illustrating a motion assistance apparatus according to at least one example embodiment.
Figure 4:
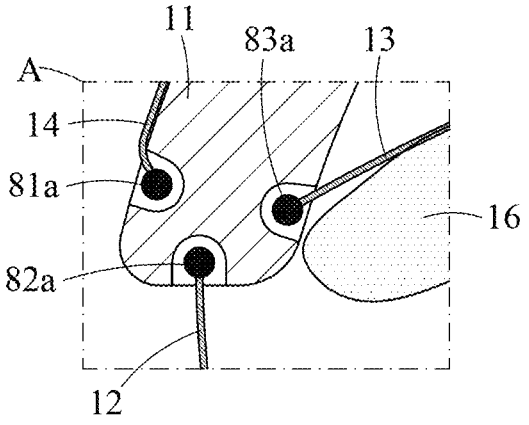
FIG. 4 is an enlarged view of a portion A of FIG. 3B.
Figure 5:
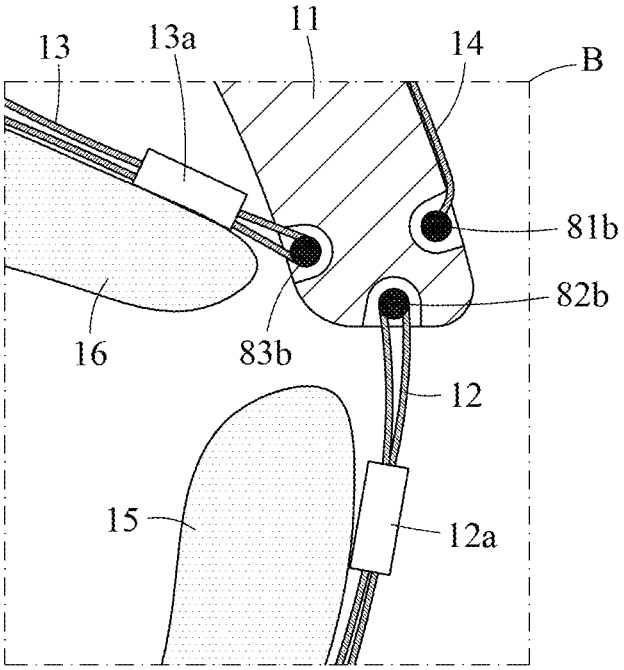
FIG. 5 is an enlarged view of a portion B of FIG. 3B.

FIG. 3A is a cross-sectional view illustrating a motion assistance apparatus according to at least one example embodiment, FIG. 3B is a cross-sectional view illustrating a motion assistance apparatus according to at least one example embodiment, FIG. 4 is an enlarged view of a portion A of FIG. 3B, and FIG. 5 is an enlarged view of a portion B of FIG. 3B.

Referring to FIGS. 3A through 5, a motion assistance apparatus may include the power transmitting frame 93, the driving frame 11 connected to the power transmitting frame 93, a rear belt 12, a front belt 13, a reinforcement belt 14 attached to a front surface of the driving frame 11, a rear pad 15 provided on an inner side of the rear belt 12, and a front pad 16 provided on an inner side of the front belt 13. Here, the terms "front" and "rear" may refer to a front side and a rear side of the user who is standing erect. In FIG. 3B, an upper side indicates the front, and a lower side indicates the rear.

The driving frame 11 may enclose a front portion of the distal part of the user, and the power transmitting frame 93 may be connected to the driving frame 11. For example, the driving frame 11 may be provided in the shape that encloses the front portion of the distal part and does not enclose a rear portion of the distal part. For example, a cross-section of an outer surface of the driving frame 11 may be in the curved shape, and a pair of virtual lines extending from both end portions of the curved shape in respective tangential directions may not meet. For example, at least a portion of the power transmitting frame 93 may be inserted into the driving frame 11.

When the power transmitting frame 93 moves the driving frame 11 in a forward direction, the rear belt 12 may push the distal part forward in response to the movement of the driving frame 11. The rear belt 12 may be connected to the driving frame 11 or the reinforcement belt 14, and support the rear surface of the distal part of the user. For example, both sides of the rear belt 12 may be connected respectively to both sides of the driving frame 11 or to both sides of the reinforcement belt 14. Meanwhile, the rear belt 12, the front belt 13, and the reinforcement belt 14 may connected to one another at a point. The front belt 13 may be provided between the driving frame 11 and the rear belt 12 and support the front surface of the distal part of the user. For example, when the power transmitting frame 93 moves the driving frame 11 in a backward direction, the front belt 13 may push the distal part backward in response to the movement of the driving frame 11. The front belt 13 may be connected to the driving frame 11 or the reinforcement belt 14. For example, both sides of the front belt 13 may be connected respectively to both sides of the driving frame 11 or to both sides of the reinforcement belt 14.

The front belt 13 may be provided as an integral body with the reinforcement belt 14. The front belt 13 and the reinforcement belt 14 may be provided in the form enclosing the driving frame 11, which will be described further below with reference to FIG. 10. The reinforcement belt 14 may be attached to a front surface of the driving frame 11. The reinforcement belt 14 may assist the driving frame 11 not to be deformed in a direction in which a curvature increases. That is, the reinforcement belt 14 may inhibit (or, alternatively, prevent) the driving frame 11 from being deformed to a shape in which both end portions of the driving frame 11 approach each other.

First, when the power transmitting frame 93 moves the driving frame 11 in a forward direction and the rear belt 12 applies a pushing force to the rear surface of the distal part of the user, a tensile force that pulls both ends of the driving frame 11 in a rear direction may be applied to the rear belt 12 by a reaction force. Although this tensile force is applied in the direction in which the curvature of the driving frame 11 increases, the reinforcement belt 14 may inhibit (or, alternatively, prevent) the driving frame 11 from being deformed in the direction in which the end portions of the driving frame 11 approach each other.

Conversely, when the power transmitting frame 93 moves the driving frame 11 in a backward direction and the front belt 13 applies a pushing force to the front surface of the distal part of the user, a tensile force that pulls both ends of the driving frame 11 in an inward direction may be applied to the front belt 13 by a reaction force. Although this tensile force is applied in the direction in which the curvature of the driving frame 11 increases, the reinforcement belt 14 may inhibit (or, alternatively, prevent) the driving frame 11 from being deformed in the direction in which the end portions of the driving frame 11 approach each other.

The rear belt 12, the front belt 13, and the reinforcement belt 14 may be formed of a non-stretchable material. For example, the rear belt 12, the front belt 13, and the reinforcement belt 14 may be bent, but may not extend or shrink. That is, the rear belt 12, the front belt 13, and the reinforcement belt 14 may not have elasticity. For example, the rear belt 12, the front belt 13, and the reinforcement belt 14 may be webbing. The rear belt 12 and the front belt 13 may not have elasticity and thus, may not cause a delay in operation in response to an increase or decrease in elastic potential energy and may quickly and intactly transmit the power received from the driving frame 11 to the distal part of the user. Further, by using a relatively thin and light-weighted reinforcement belt 14, an increase in the overall volume and weight of the apparatus may be reduced (or, alternatively, minimized), and a deformation of the driving frame 11 may be effectively reduced (or, alternatively, prevented).

The driving frame 11 may be provided in the shape that is convex in a direction away from the front belt 13. A rear portion of the driving frame 11 may face the front belt 13 and be provided in a concave shape. When the user wears the motion assistance apparatus, a curvature of the rear surface of the driving frame 11 may be greater than a curvature of the front belt 13. That is, a radius of curvature of the rear surface of the driving frame 11 may be less than a radius of curvature of the front belt 13. A front portion of the driving frame 11 may be provided in a convex shape. The rear portion of the driving frame 11 may provide a space sufficient for the front belt 13 to move back and forth. For example, when a length of the front belt 13 increases, a central portion of the front belt 13 may approach the driving frame 11. When the length of the front belt 13 decreases, the central portion of the front belt 13 may retreat from the driving frame 11. For example, a length of a portion of the front belt 13 connecting both end portions of the driving frame 11 may be greater than a length of a chord rectilinearly connecting the end portions of the driving frame 11. In this structure, when the user wears the motion assistance apparatus, the closed-loop shape formed by the driving frame 11 and the front belt 13 may be a shape of a crescent moon.

The rear pad 15 may be provided on an inner side surface of the rear belt 12. The rear pad 15 may be provided between the rear belt 12 and the distal part of the user. The rear pad 15 may include a material having elasticity. The rear pad 15 may be deformed to fit the shape of the distal part of the user. The rear pad 15 may be detachable from the rear belt 12.

The front pad 16 may be provided on an inner side surface of the front belt 13. The front pad 16 may be provided between the front belt 13 and the distal part of the user. The front pad 16 may include a material having elasticity. The front pad 16 may be deformed to fit the shape of the distal part of the user. The front pad 16 may be detachable from the front belt 13.

A first left fixing member 81*a*, a second left fixing member 82*a*, and a third left fixing member 83*a* may be provided in a left end portion of the driving frame 11. A first right fixing member 81*b*, a second right fixing member 82*b*, and a third right fixing member 83*b* may be provided in a right end portion of the driving frame 11. The left fixing members 81*a*, 82*a*, and 83*a* and the right fixing members 81*b*, 82*b*, and 83*b* may be provided in the shape that supports or fixes the rear belt 12, the front belt 13, or the reinforcement belt 14. For example, the left fixing members 81*a*, 82*a*, and 83*a* and the right fixing members 81*b*, 82*b*, and 83*b* may be rods formed in the driving frame 11 or loops with holes through which the belts 12, 13, and 14 may pass.

When the driving frame 11 intends to be deformed in a direction in which the curvature increases, that is, when the driving frame 11 intends to be deformed in a direction in which both end portions of the driving frame 11 approach each other, the reinforcement belt 14 attached to the front surface of the driving frame 11 may maintain a state in which one end of the reinforcement belt 14 is fixed to the first left fixing member 81*a*, the other end thereof is fixed to the first right fixing member 81*b*, and a central portion thereof is attached to the driving frame 11. For example, a portion or an entirety of the reinforcement belt 14 may be fixed to the front surface of the driving frame 11 using an adhesive material such as glue. For example, the portion or the entirety of the reinforcement belt 14 may be fixed to the front surface of the driving frame 11 using various fastening devices such as, for example, a screw, a rivet, and/or a snap fastener.

One end of the rear belt 12 may be fixed to the second left fixing member 82*a*, a central portion of the rear belt 12 may enclose the second right fixing member 82*b*, and the other end of the rear belt 12 may be disposed on an opposite side of the rear pad 15 based on the central portion of the rear belt 12. The rear belt 12 may adjust a length of a portion connected from one end of the driving frame 11 to the other end of the driving frame 11. That is, the length of the rear belt 12 connected from the second left fixing member 82*a* to the second right fixing member 82*b* may be adjusted. The rear belt 12 may include a rear length adjusting member 12*a*. The rear length adjusting member 12*a* may connect two portions of the rear belt 12 and selectively fix a relative movement of the two portions. A user may release a fixing state of the two portions of the rear belt 12 by controlling the rear length adjusting member 12*a*, and adjust the length of the rear belt 12.

For example, the rear length adjusting member 12*a* may be a hook-and-loop fastener. That is, the rear length adjusting member 12*a* may include a hook formed on one side of the rear belt 12 and a loop formed on the other side of the rear belt 12. In this structure, by changing a relative attachment position of the hook and the loop, the length of the rear belt 12 may be adjusted. Hereinafter, similar to the rear length adjusting member 12*a*, a front length adjusting member 13*a* and other length adjusting members described below may be in the structure of a hook-and-loop fastener.

One end of the front belt 13 may be fixed to the third left fixing member 83*a*, a central portion of the front belt 13 may enclose the third right fixing member 83*b*, and the other end of the front belt 13 may be disposed between the central portion of the front belt 13 and the driving frame 11. The front belt 13 may adjust a length of a portion connected from one end of the driving frame 11 to the other end of the driving frame 11. That is, the length of the front belt 13 connected from the third left fixing member 83*a* to the third right fixing member 83*b* may be adjusted. The front belt 13 may include the front length adjusting member 13*a*. The front length adjusting member 13*a* may connect two portions of the front belt 13 and selectively fix a relative movement of the two portions. The user may release a fixing state of the two portions of the front belt 13 by controlling the front length adjusting member 13*a*, and adjust the length of the front belt 13. Since an end portion of the front belt 13 not fixed to the driving frame 11 is positioned between the driving frame 11 and the central portion of the front belt 13, the user may easily adjust the length of the front belt 13.

Figure 6:
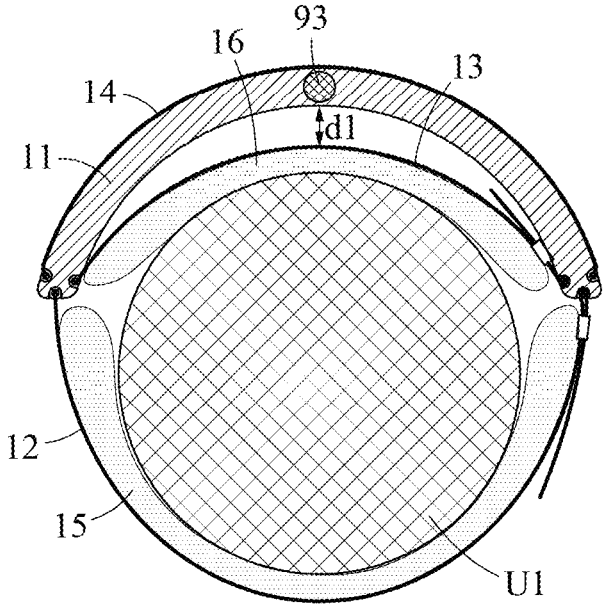
FIG. 6 is a cross-sectional view illustrating a motion assistance apparatus supporting a distal part with a relatively small cross-sectional area according to at least one example embodiment.
Figure 7:
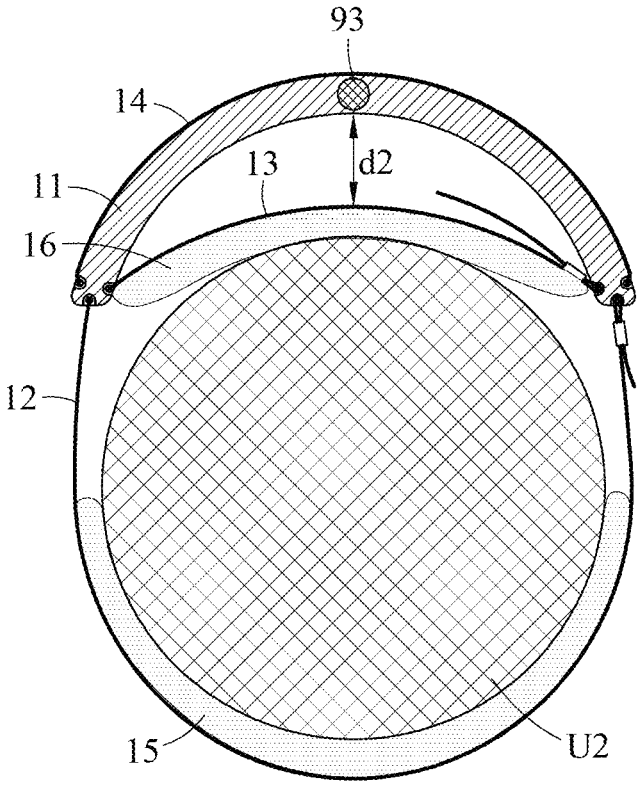
FIG. 7 is a cross-sectional view illustrating a motion assistance apparatus supporting a distal part with a relatively great cross-sectional area according to at least one example embodiment.

FIG. 6 is a cross-sectional view illustrating a motion assistance apparatus supporting a distal part with a relatively small cross-sectional area according to at least one example embodiment, and FIG. 7 is a cross-sectional view illustrating the motion assistance apparatus supporting a distal part with a relatively great cross-sectional area according to at least one example embodiment.

Referring to FIGS. 6 and 7, a motion assistance apparatus may stably support a distal part of a user U1, U2 by adjusting a length of the rear belt 12 and a length of the front belt 13 based on the size of the distal part of the user U1, U2. For example, if the size of the distal part of the user U1 is relatively small as shown in FIG. 6, the motion assistance apparatus may place the distal part of the user U1 close to the driving frame 11 and stably support the distal part of the user U1, by reducing the length of the rear belt 12 and increasing the length of the front belt 13. Here, adjusting the length of the rear belt 12 or the front belt 13 may refer to adjusting a length of a portion of the rear belt 12 or the front belt 13 connecting both end portions of the driving frame 11. In this example, a distance from a central portion of the front belt 13 to the driving frame 11 may be d1. A rear surface of the distal part of the user U1 may be supported by the rear belt 12 and the rear pad 15, and a front surface thereof may be supported by the front belt 13 and the front pad 16. While power is transmitted to the driving frame 11 through the power transmitting frame 93, a deformation of the driving frame 11 may be reduced or prevented by the reinforcement belt 14.

Meanwhile, if the size of the distal part of the user U2 is relatively great as shown in FIG. 7, for example, if the width of the distal part of the user U2 is greater than the width of the driving frame 11, the motion assistance apparatus may stably support the distal part of the user U2 by increasing the length of the rear belt 12 and decreasing the length of the front belt 13. In this example, the distance from the central portion of the front belt 13 to the driving frame 11 may be d2 which is greater than d1.

Figure 8:
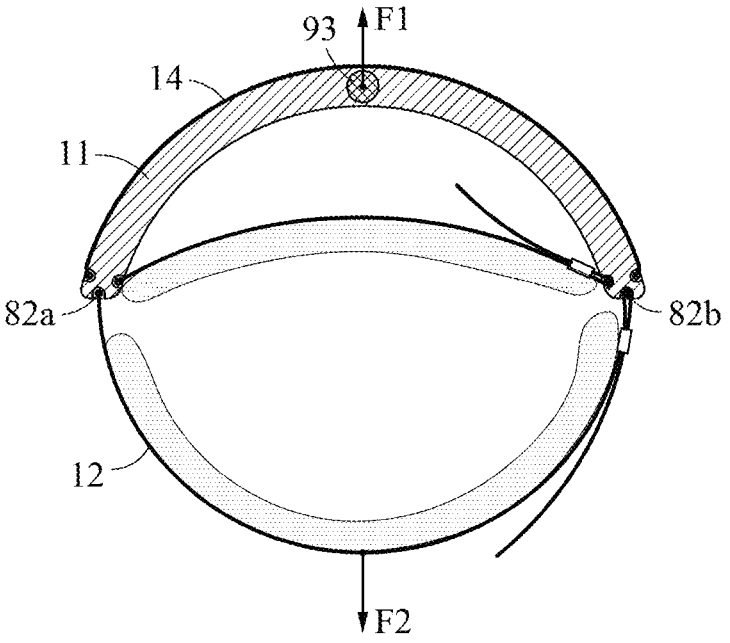
FIG. 8 is a cross-sectional view illustrating a relationship between a force applied to a driving frame and a force applied to a rear belt while a motion assistance apparatus provides an assistance force to move a distal part of a user in a forward direction according to at least one example embodiment.

FIG. 8 is a cross-sectional view illustrating a relationship between a force applied to a driving frame and a force applied to a rear belt while a motion assistance apparatus provides an assistance force to move a distal part of a user in a forward direction according to at least one example embodiment.

Referring to FIG. 8, while the power transmitting frame 93 is transmitting power to the driving frame 11 in forward direction F1, the rear belt 12 may receive a force from a distal part of a user (not shown) in an opposite direction F2. In this example, both ends of the rear belt 12 may pull the driving frame 11 in a backward direction. One end of the rear belt 12 may pull the second left fixing member 82*a* in the backward direction, and the other end thereof may pull the second right fixing member 82*b* in the backward direction. As described above, an action force applied to the driving frame 11 may be offset by a tensile force of the reinforcement belt 14, whereby a deformation of the driving frame 11 may be reduced (or, alternatively, prevented). A curvature of a front surface of the driving frame 11 may be maintained to be equal to a curvature of the reinforcement belt 14.

Figure 9:
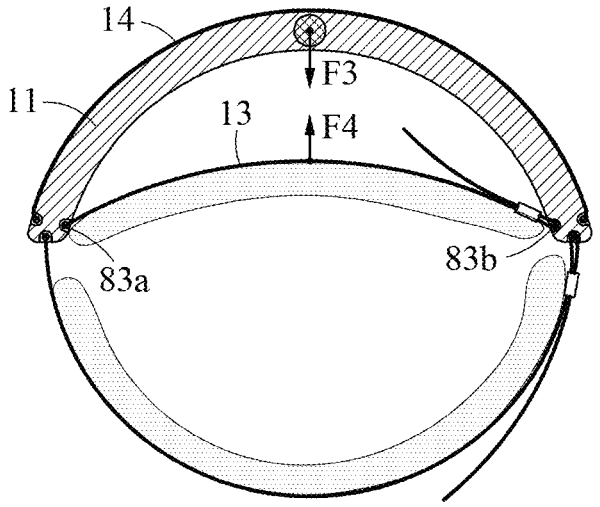
FIG. 9 is a cross-sectional view illustrating a relationship between a force applied to a driving frame and a force applied to a rear belt while a motion assistance apparatus provides an assistance force to move a distal part of a user in a backward direction according to at least one example embodiment.

FIG. 9 is a cross-sectional view illustrating a relationship between a force applied to a driving frame and a force applied to a rear belt while a motion assistance apparatus provides an assistance force to move a distal part of a user in a backward direction according to at least one example embodiment.

Referring to FIG. 9, while the power transmitting frame 93 is transmitting power to the driving frame 11 in a backward direction F3, the front belt 13 may receive a force from a distal part of a user (not shown) in an opposite direction F4. In this example, both ends of the front belt 13 may pull both ends of the driving frame 11 in an inward direction. One end of the front belt 13 may pull the third left fixing member 83*a* inward, and the other end thereof may pull the third right fixing member 83*b* inward. As described above, an action force applied to the driving frame 11 may be offset by a tensile force of the reinforcement belt 14, whereby a deformation of the driving frame 11 may be reduced (or, alternatively, prevented).

Figure 10:
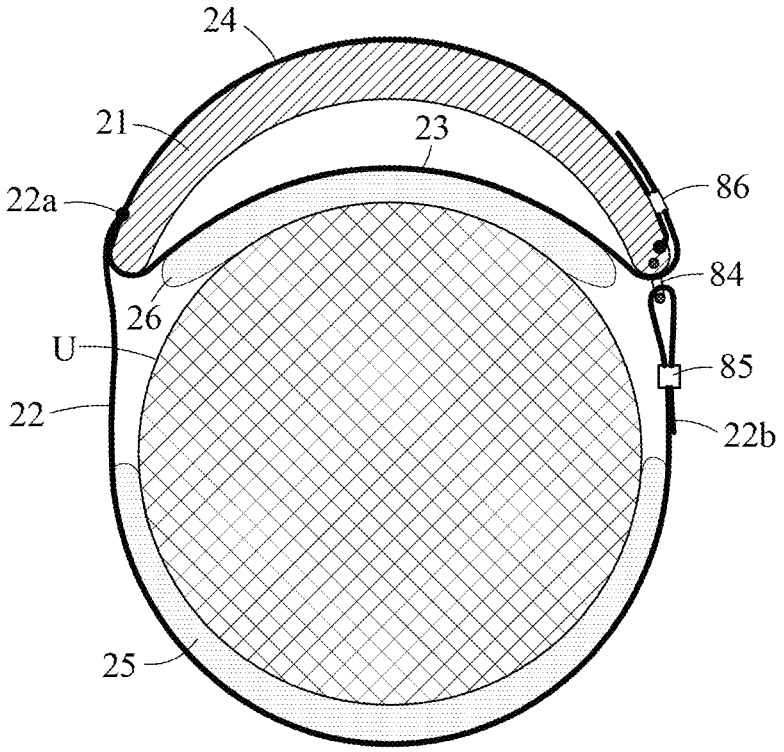
FIG. 10 is a cross-sectional view illustrating a motion assistance apparatus according to at least one example embodiment.

FIG. 10 is a cross-sectional view illustrating a motion assistance apparatus according to at least one example embodiment.

Referring to FIG. 10, a motion assistance apparatus may include a driving frame 21, a rear belt 22, a front belt 23, a reinforcement belt 24 attached to a front surface of the driving frame 21, a rear pad 25 provided on an inner side of the rear belt 22, a front pad 26 provided on an inner side of the front belt 23, a belt supporting part 84, a rear length adjusting member 85, and a front length adjusting member 86. The motion assistance apparatus may stably support a distal part of a user U by adjusting a length of the rear belt 22 and/or the front belt 23 based on the size of the distal part of the user U.

For ease of description, the reinforcement belt 24 and the front belt 23 may be described separately. However, the reinforcement belt 24 and the front belt 23 may be provided as an integral body. In a single belt, a portion attached to the front surface of the driving frame 21 may be referred to as the reinforcement belt 24, and a portion provided between the driving frame 21 and the rear belt 22 may be referred to as the front belt 23. An end portion of the front belt 23 not connected to the reinforcement belt 24 may be fixed to the reinforcement belt 24 by the front length adjusting member 86. For example, the front length adjusting member 86 may be a hook-and-loop fastener. In this example, a hook may be provided in one of the reinforcement belt 24 and the front belt 23, and a loop may be provided in the other one. That is, a portion of the front length adjusting member 86 may be provided in the reinforcement belt 24, and a remaining portion of the front length adjusting member 86 may be provided in the front belt 23. A user may adjust a curvature of the front belt 23 by utilizing the front length adjusting member 86.

The belt supporting part 84 may be connected to the driving frame 11 and support the rear belt 22. For example, the belt supporting part 84 may be provided in the shape of a loop and allow the rear belt 22 and/or the front belt 23 to pass therethrough.

The rear length adjusting member 85 may mutually fix a portion of the rear belt 22 not passing through the belt supporting part 84 and a portion thereof passing through the belt supporting part 84. For example, the rear length adjusting member 85 may be a hook-and-loop fastener. One portion 22*a* of the rear belt 22 may be fixed to the reinforcement belt 24. The other side of the rear belt 22 may pass through the belt supporting part 84 and fixed to another portion 22*b* of the rear belt 22 by the rear length adjusting member 85.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A motion assistance apparatus, comprising:

a proximal support configured to support a proximal part of a user;

a power transmitting frame configured to rotate relative to the proximal support;

a driving frame connected to the power transmitting frame, the driving frame configured to enclose at least a portion of a distal part of the user;

a reinforcement belt connected to a front surface of the driving frame;

a rear belt connected to one of the driving frame or the reinforcement belt, the rear belt configured to support a rear surface of the distal part of the user; and a front belt between the driving frame and the rear belt such that a central portion of the front belt is spaced apart from the driving frame, the front belt configured to support a front surface of the distal part of the user.

2. The motion assistance apparatus of claim 1, wherein a shape of the driving frame is convex.

3. The motion assistance apparatus of claim 1, wherein the rear belt, the front belt, and the reinforcement belt are non-stretchable.

4. The motion assistance apparatus of claim 3, further comprising:

a rear pad on an inner side surface of the rear belt; and a front pad on an inner side surface of the front belt.

5. The motion assistance apparatus of claim 1, wherein the reinforcement belt is configured to inhibit a left end portion of the driving frame from approaching a right end portion of the driving frame.

6. The motion assistance apparatus of claim 5, wherein a left end portion of the reinforcement belt is fixed to the left end portion of the driving frame, and a right end portion of the reinforcement belt is fixed to the right end portion of the driving frame.

7. The motion assistance apparatus of claim 5, wherein while the power transmitting frame is transmitting power to the driving frame in a forward direction relative to the user, the rear belt is configured to transmit an action force that pulls the left end portion of the driving frame and the right end portion of the driving frame in a rear direction relative to the user, and the reinforcement belt is configured to apply a tensile force to offset at least a portion of the action force to inhibit the left end portion of the driving frame from approaching the right end portion of the driving frame.

8. The motion assistance apparatus of claim 5, wherein while the power transmitting frame is transmitting power to the driving frame in a rear direction relative to the user, the front belt is configured to transmit an action force that pulls the left end portion of the driving frame and the right end portion of the driving frame in an inward direction, and the reinforcement belt is configured to apply a tensile force to offsets at least a portion of the action force to inhibit the left end portion of the driving frame from approaching the right end portion of the driving frame.

9. The motion assistance apparatus of claim 1, wherein a curvature of the front surface of the driving frame is equal to a curvature of the reinforcement belt.

10. The motion assistance apparatus of claim 1, wherein a curvature of a rear surface of the driving frame is greater than a curvature of the front belt.

11. The motion assistance apparatus of claim 1, wherein a length of the rear belt is greater than a length of the front belt.

12. The motion assistance apparatus of claim 1, wherein a length of one of the rear belt or the front belt from a first end portion of the driving frame to a second end portion of the driving frame is adjustable.

13. The motion assistance apparatus of claim 12, wherein a first end of the front belt is fixed to a first end portion of the driving frame, at least a portion of the front belt encloses a fixing member at a second end portion of the driving frame, and a second end of the front belt is between the central portion of the front belt and the driving frame.

14. The motion assistance apparatus of claim 1, wherein the proximal support is configured to support a waist of the user, and the rear belt and the front belt are configured to support a thigh of the user.

15. The motion assistance apparatus of claim 1, wherein the proximal support is configured to support a thigh of the user, and the rear belt and the front belt are configured to support a calf and a shin of the user, respectively.

16. The motion assistance apparatus of claim 1, wherein the reinforcement belt and the front belt are provided as an integral body, and the motion assistance apparatus further comprises:

a front length adjusting member configured to fix the reinforcement belt with the front belt.

17. The motion assistance apparatus of claim 1, further comprising:

a belt support connected to the driving frame, the belt support configured to support the rear belt; and a rear length adjuster configured to fix a portion of the rear belt not passing through the belt support with a portion of the rear belt passing through the belt supporting part.

18. The motion assistance apparatus of claim 17, wherein a first end of the rear belt is fixed to the reinforcement belt, and a second end of the rear belt passes through the belt support and is fixed by the rear length adjuster.

19. A motion assistance apparatus, comprising:

a driving frame configured to enclose at least a portion of a distal part of a user;

a rear belt connected to a first end portion and a second end portion of the driving frame, the rear belt configured to support a rear surface of the distal part of the user;

a front belt connected to the first and second end portions of the driving frame such that a central portion of the front belt is spaced apart from the driving frame, the front belt configured to support a front surface of the distal part of the user; and a reinforcement belt extending along a front surface of the driving frame with end portions of the reinforcement belt fixed to the driving frame.

* * * * *